US008533872B1

(12) United States Patent
Rodriguez

(10) Patent No.: US 8,533,872 B1
(45) Date of Patent: Sep. 17, 2013

(54) SPINAL TRAUMA PLATE FOR PROTECTING SPINAL CORD

(76) Inventor: Shawn E. Rodriguez, Muskegon, MI (US)

( * ) Notice: Subject to any disclaimer, the term of this patent is extended or adjusted under 35 U.S.C. 154(b) by 161 days.

(21) Appl. No.: 12/972,906

(22) Filed: Dec. 20, 2010

Related U.S. Application Data

(63) Continuation-in-part of application No. 12/908,585, filed on Oct. 20, 2010, now abandoned.

(60) Provisional application No. 61/253,420, filed on Oct. 20, 2009.

(51) Int. Cl.
*A41D 13/00* (2006.01)

(52) U.S. Cl.
USPC ..... 2/467; 2/2.5

(58) Field of Classification Search
USPC ..... 2/467, 2.5, 459–463, 456, 455
See application file for complete search history.

(56) References Cited

U.S. PATENT DOCUMENTS

| | | | | | |
|---|---|---|---|---|---|
| 3,891,996 | A * | 7/1975 | Leach et al. | 2/2.5 |
| 4,079,464 | A | 3/1978 | Roggin | |
| 4,183,097 | A | 1/1980 | Mellian | |
| 4,593,788 | A * | 6/1986 | Miller | 182/3 |
| 4,680,812 | A * | 7/1987 | Weigl | 2/467 |
| 4,697,285 | A * | 10/1987 | Sylvester | 2/2.5 |
| 4,866,789 | A * | 9/1989 | Dorm | 2/462 |
| 4,870,706 | A * | 10/1989 | Ketcham et al. | 2/461 |
| 4,884,295 | A * | 12/1989 | Cox | 2/467 |
| 5,008,959 | A | 4/1991 | Coppage, Jr. et al. | |
| 5,179,244 | A * | 1/1993 | Zufle | 89/36.02 |
| 5,305,471 | A * | 4/1994 | Steele et al. | 2/102 |
| 5,327,811 | A * | 7/1994 | Price et al. | 2/2.5 |
| 5,465,424 | A * | 11/1995 | Cudney et al. | 2/462 |
| 5,479,659 | A * | 1/1996 | Bachner, Jr. | 2/2.5 |
| 5,754,982 | A * | 5/1998 | Gainer | 2/2.5 |
| 5,768,717 | A * | 6/1998 | Le Sueur | 2/467 |
| 6,219,852 | B1 * | 4/2001 | Bain et al. | 2/456 |
| D452,047 | S | 12/2001 | Ditchfield et al. | |
| 6,823,529 | B1 * | 11/2004 | Dako | 2/2.5 |
| 6,961,957 | B2 * | 11/2005 | Carlson | 2/2.5 |
| 6,961,958 | B1 * | 11/2005 | Seitzinger | 2/2.5 |
| 7,251,835 | B2 * | 8/2007 | Learmont | 2/2.5 |
| 7,424,748 | B1 * | 9/2008 | McDunn et al. | 2/2.5 |
| 7,546,853 | B2 * | 6/2009 | Rock et al. | 139/391 |
| 7,568,966 | B2 * | 8/2009 | Abbey et al. | 450/1 |
| 7,865,967 | B2 * | 1/2011 | Van Winkle et al. | 2/2.5 |
| 7,987,520 | B2 * | 8/2011 | Henriquez | 2/69 |
| 2005/0193480 | A1 * | 9/2005 | Carlson | 2/463 |
| 2007/0016996 | A1 * | 1/2007 | Seitzinger et al. | 2/2.5 |
| 2007/0079414 | A1 * | 4/2007 | Learmont | 2/2.5 |
| 2008/0087161 | A1 * | 4/2008 | Dean et al. | 89/36.05 |
| 2008/0178358 | A1 * | 7/2008 | Learmont | 2/2.5 |
| 2009/0320171 | A1 * | 12/2009 | Kocher et al. | 2/2.5 |

* cited by examiner

*Primary Examiner* — Khoa Huynh
*Assistant Examiner* — Andrew W Collins

(57) ABSTRACT

The present invention features a ballistic vest 100 for protecting a spinal cord of a person wearing the ballistic vest. In some embodiments, the ballistic vest 100 comprises a pocket 110 disposed on the backside of the vest at a place where it overlays the user's spinal cord and a soft or hard trauma plate 120 that is inserted into the pocket 110. The trauma plate is effective to prevent a projectile from damaging the user's spine.

5 Claims, 3 Drawing Sheets

(ISO View)

(Back View)

(ISO View)

(Exploded View)

(Back View)

(Front View)

(Cross-sectional View)

SPINAL TRAUMA PLATE FOR PROTECTING SPINAL CORD

CROSS REFERENCE

This application claims priority to U.S. Non-provisional application Ser. No. 12/908,585 filed Oct. 20, 2010 and U.S. provisional application Ser. No. 61/253,420 filed Oct. 20, 2009, the specifications of which are incorporated herein by reference in its entirety.

BACKGROUND OF THE INVENTION

Currently, soft trauma plates are often added to body armor to provide extra protection to the heart of a person wearing the body armor. However, danger, such as gun shots, explosions, or stabbings, may come from all directions, and a human body has other important areas that may also need extra protection.

SUMMARY OF THE INVENTION

The present invention features a ballistic vest 100 for protecting a spinal cord of a person wearing the ballistic vest. In some embodiments, the ballistic vest 100 comprises a pocket 110 disposed on the backside of the vest at a place where it overlays the user's spinal cord and a soft or hard trauma plate 120 that is inserted into the pocket 110, The trauma plate is effective to prevent a projectile from damaging the user's spine.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
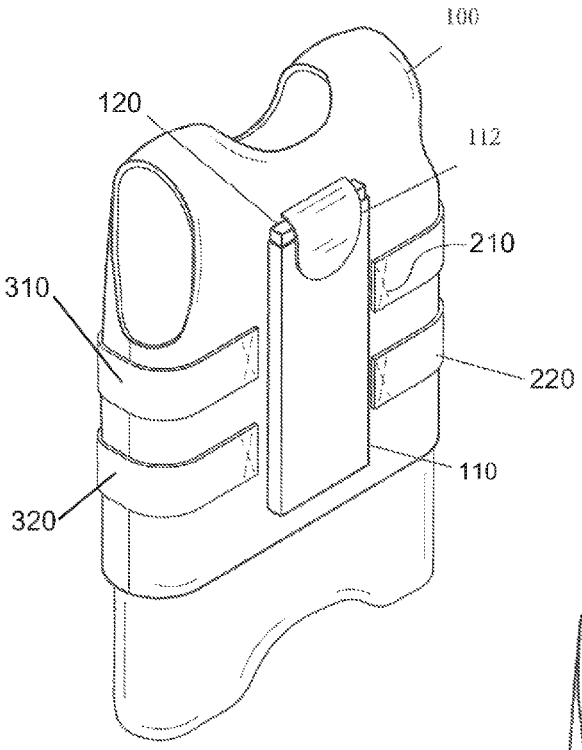
FIG. 1 is a perspective view of a spinal soft or hard trauma plate in accordance with an embodiment of the present invention.
Figure 2:
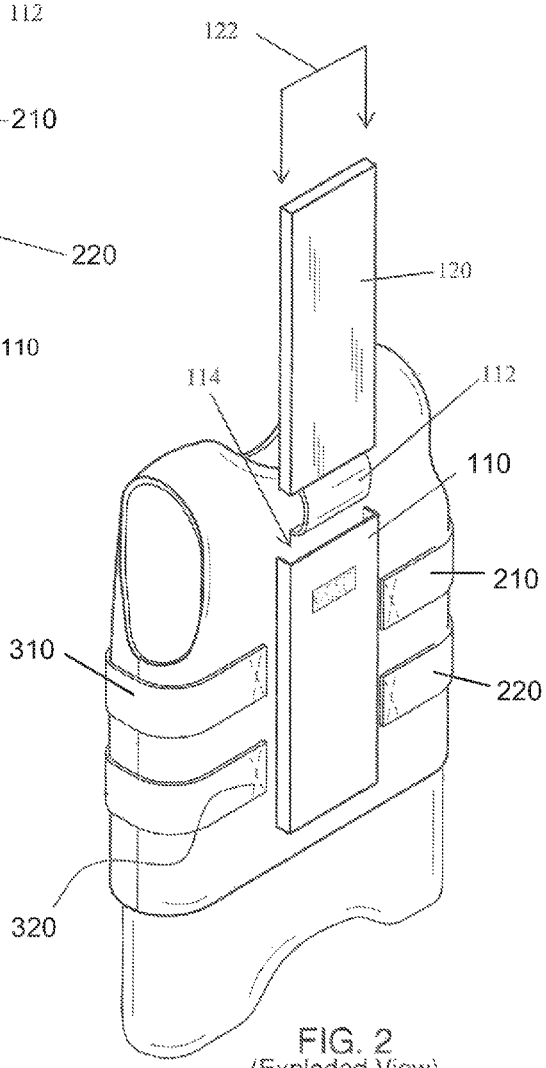
FIG. 2 is an exploded view of a spinal soft or hard trauma plate in accordance with an embodiment of the present invention.
Figure 3:
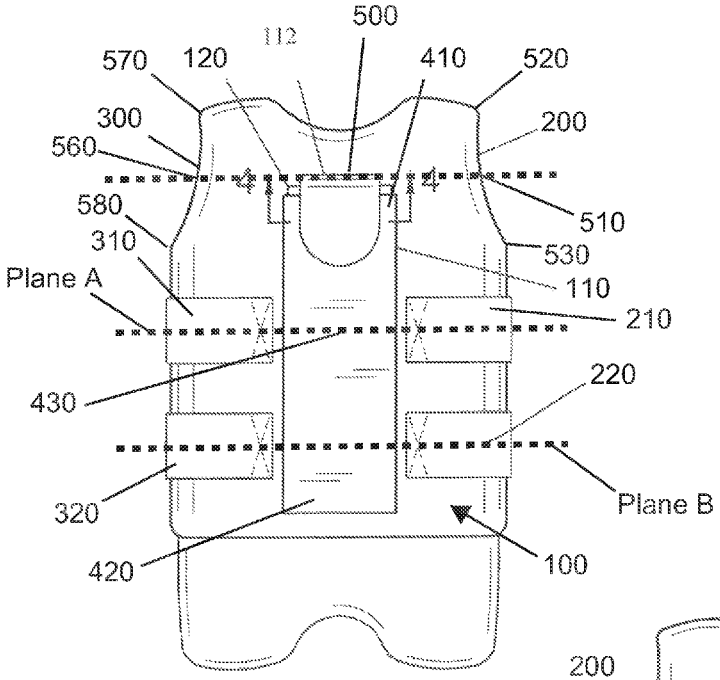
FIG. 3 is a back view of a spinal soft or hard trauma plate in accordance with an embodiment of the present invention.
Figure 3A:
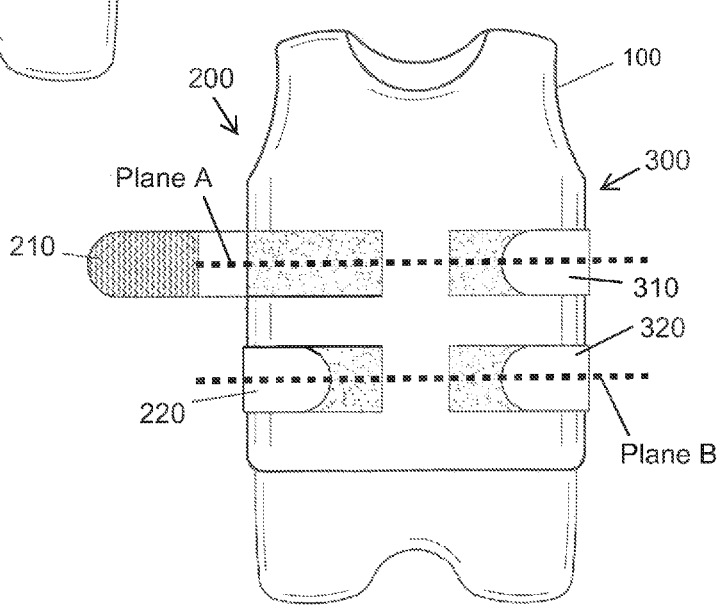
FIG. 3A is a front view of a spinal soft or hard trauma plate in accordance with an embodiment of the present invention.
Figure 4:
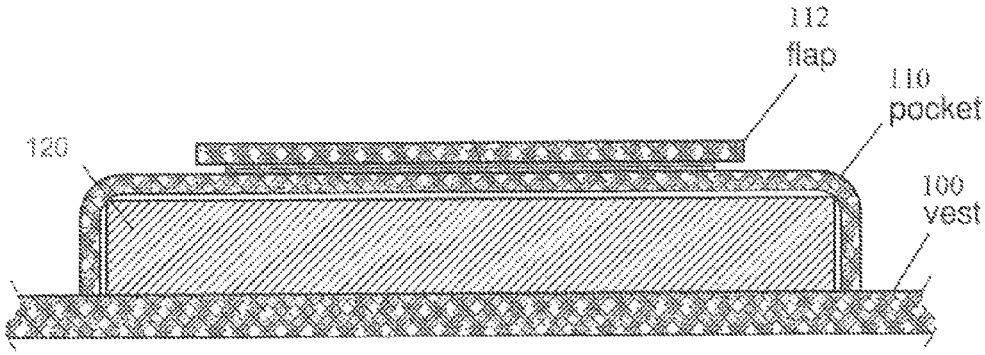
FIG. 4 is a cross-sectional view of a spinal soft or hard trauma plate in accordance with an embodiment of the present invention.

The present invention features a ballistic vest 100 for protecting a spinal cord of a person wearing the ballistic vest 100. In some embodiments, the ballistic vest 100 comprises a vest first side 200 and a vest second side 300. In some embodiments the ballistic vest 100 comprises a vest front panel and a vest rear panel. In some embodiments, the ballistic vest comprises a first side top vest attachment member 210 and a first side bottom vest attachment member 220. In some embodiments, the ballistic vest comprises a second side top vest attachment member 310 and a second side bottom vest attachment member 320. In some embodiments, the ballistic vest comprises a single pocket 110 having a pocket top 410, a pocket bottom 420, and a pocket midpoint 430 about halfway between the pocket top 410 and the pocket bottom 420. In some embodiments, the ballistic vest comprises a single pocket located on the backside of the ballistic vest at a place where it overlay's the person's spinal cord. In some embodiments, an uppermost tip of the single pocket lies next to a horizontal plane intersecting a vest arm hole first side vertical midpoint and a vest arm hole second side vertical midpoint. In some embodiments, the vest arm hole first side vertical midpoint is located midway between a vest arm hole first side top edge close to a shoulder of the person wearing the ballistic vest, and a vest arm hole first side bottom edge close to an armpit of the person wearing the ballistic vest on the vest first side. In some embodiments, the vest arm hole second side vertical midpoint is located midway between a vest arm hole second side top edge close to a shoulder of the person wearing the ballistic vest, and a vest arm hole second side bottom edge close to an armpit of the person wearing the ballistic vest on the vest second side. The present invention features a spinal hard trauma plate. FIG. 1 shows an improved body armor having a spinal hard trauma plate on the back panel of the body armor in order to provide additional protection for the spine of a user wearing the body armor. In some embodiments, the single pocket 110 is adapted to accommodate a single, unitary hard trauma plate 120. In some embodiments, a first side top vest attachment member 210 is disposed in line with a pocket midpoint 430 of the single pocket 110 on a vest first side 200 between the pocket top 410 and the pocket bottom 420. In some embodiments, a second side top vest attachment member 310 is disposed in line with the pocket midpoint 430 of the single pocket 110 on a vest second side 300 between the pocket top 410 and the pocket bottom 420. In some embodiments, a first side bottom vest attachment member 220 is disposed between the first side top vest attachment member 210 and pocket bottom 420 on a vest first side 200. In some embodiments, a second side bottom vest attachment member 320 is disposed between the second side top vest attachment member 310 and the pocket bottom 420 on a vest second side 300.

The spinal soft or hard trauma plate is sized so that it is long enough to cover the user's spine, depending on the size of body armor issued. The spinal soft or hard trauma plate may substantially or completely cover a user's spine, depending on factors such as the size of the back panel of the body armor. For example, 3 chest trauma plates, each 8 inches width and 10 inches in height, may be laid out lengthwise in order to create an 8 inch wide and 30 inch long solid piece of spinal soft or hard trauma plate that covers the user's spine or spinal cord.

In some embodiments, a flap 112 is disposed at an opening 114 of the pocket 110, wherein the flap can temporarily close the opening of the pocket 110 to secure the trauma plate therein. The flap can close over the opening of the pocket 114 via an attachment means such as a hook-and-loop mechanism (e.g., Velcro®). In some embodiments, the flap (112) attaches to the backside of the vest (100) at a location that lies on the horizontal plane intersecting the vest arm hole first side vertical midpoint (510) and the vest arm hole second side vertical midpoint (560). In some embodiments, the location of the attachment for the flap is designed for preventing the single, unitary hard trauma plate 120 from sliding upwards out of the single pocket 110.

In some embodiments, the trauma plate 120 has a width 122 of about 1.5 inches to about 7 inches. In some embodiments, the trauma plate 120 has a width 122 of about 2 inches to 6 inches. In some embodiments, the trauma plate 1200 has a width 122 of about 2 inches to 4 inches.

In some embodiments, the spinal soft trauma plate is one solid piece and has no breaks, adjoining pieces, or interlocking pieces that would allow for a point of weakness or entry for a projectile.

The spinal soft or hard trauma plate is light weight, and may weigh less than 1.5 pounds.

The spinal trauma plate may be made of materials currently used on chest trauma plates, such as Kevlar®, or any other suitable soft antiballistic material.

In order to accommodate the spinal soft or hard trauma plate, a cloth sheath or pocket can be sewn into the back panel's carrier of a body armor to create a secure pocket that will hold the spinal soft or hard trauma plate in position so that the spinal soft or hard trauma plate runs longitudinally down the center back panel of the body armor and covers the spine of the user wearing the body armor. The spinal soft or hard plate may also be attached to the back ballistic panel of the body armor by any other suitable methods as if in combat. In some embodiments, the pocket for the plate is attached to any back of a body armor without being sewn on.

By covering the spine of a body armor user, the spinal soft/hard trauma plate provides extra protection to the spinal cord and may help to prevent paralysis due to spinal cord injury, saves lives, reduce the energy of projectiles, prevent bone fragments from penetrating the spinal cord, and prevent blunt force trauma to the spine caused by Back Face Deformation.

As used herein, the term "about" refers to plus or minus 10% of the referenced number.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A ballistic vest (100) for protecting a spinal cord of a person wearing the ballistic vest (100), the ballistic vest (100) comprising:

(a) a single pocket (110) disposed on the backside of the ballistic vest (100) at a place where it overlays the person's spinal cord, wherein an uppermost tip (500) of the single pocket (110) lies proximal to and below a horizontal plane intersecting a vest arm hole first side vertical midpoint (510) and a vest arm hole second side vertical midpoint (560), wherein the vest arm hole first side vertical midpoint (510) is disposed midway between a vest arm hole first side top edge (520) proximal to a shoulder of the person wearing the ballistic vest (100), and a vest arm hole first side bottom edge (530) proximal to an armpit of the person wearing the ballistic vest (100) on the vest first side (200), wherein the vest arm hole second side vertical midpoint (560) is disposed midway between a vest arm hole second side top edge (570) proximal to a shoulder of the person wearing the ballistic vest (100), and a vest arm hole second side bottom edge (580) proximal to an armpit of the person wearing the ballistic vest (100) on the vest second side (300), wherein a flap (112) is disposed proximal to an opening (114) of the single pocket (110), wherein the flap (112) attaches to the backside of the vest (100) at a location that lies on the horizontal plane intersecting the vest arm hole first side vertical midpoint (510) and the vest arm hole second side vertical midpoint (560); and (b) a single, unitary hard trauma plate (120) that is inserted into the single pocket (110), wherein the hard trauma plate (120) is a single, unitary, uninterrupted piece, wherein the hard trauma plate (120) is effective to prevent a projectile from entering into the person at a spinal region of the person wearing the ballistic vest (100), and thereby preventing the projectile from damaging the person's spine;

wherein the single pocket (110) is adapted to accommodate the single, unitary hard trauma plate (120), wherein the location of the attachment for the flap is designed for preventing the single, unitary hard trauma plate (120) from sliding upwards out of the single pocket (110), wherein the flap (112) temporarily closes the opening of the single pocket (110) to secure the single, unitary hard trauma plate (120) therein, wherein a first side top vest attachment member (210) is disposed on a plane at a pocket midpoint (430) of the single pocket (110) on a vest first side (200) between the pocket top (410) and the pocket bottom (420), wherein a second side top vest attachment member (310) is disposed on a plane at a pocket midpoint (430) of the single pocket (110) on a vest second side (300) between the pocket top (410) and the pocket bottom (420), wherein a first side bottom vest attachment member (220) is disposed on a plane between the first side top vest attachment member (210) and the lowest tip of the single pocket (110) on a vest first side (200), wherein a second side bottom vest attachment member (320) is disposed on a plane between the second side top vest attachment member (310) and the lowest tip of the single pocket (110) on a vest second side (300).

2. The vest (100) of claim 1 wherein the single, unitary hard trauma plate (120) has a width (122) of about 1.5 inches to about 7 inches.

3. The vest (100) of claim 1 wherein the single, unitary hard trauma plate (120) has a width (122) of about 2 inches to 6 inches.

4. The vest (100) of claim 1 wherein the single, unitary hard trauma plate (120) has a width (122) of about 2 inches to 4 inches.

5. A ballistic vest (100) for protecting a spinal cord of a person wearing the ballistic vest (100), the ballistic vest (100) consisting of:

(a) a single pocket (110) disposed on the backside of the ballistic vest (100) at a place where it overlays the person's spinal cord, wherein an uppermost tip (500) of the single pocket (110) lies proximal to a horizontal plane intersecting a vest arm hole first side vertical midpoint (510) and a vest arm hole second side vertical midpoint (560), wherein the vest arm hole first side vertical midpoint (510) is disposed midway between a vest arm hole first side top edge (520) proximal to a shoulder of the person wearing the ballistic vest (100), and a vest arm hole first side bottom edge (530) proximal to an armpit of the person wearing the ballistic vest (100) on the vest first side (200), wherein the vest arm hole second side vertical midpoint (560) is disposed midway between a vest arm hole second side top edge (570) proximal to a shoulder of the person wearing the ballistic vest (100), and a vest arm hole second side bottom edge (580) proximal to an armpit of the person wearing the ballistic vest (100) on the vest second side (300), wherein the flap (112) attaches to the backside of the vest (100) at a location that lies on the horizontal plane intersecting the vest arm hole first side vertical midpoint (510) and the vest arm hole second side vertical midpoint (560); and (b) a single, unitary hard trauma plate (120) that is inserted into the single pocket (110), wherein the hard trauma plate (120) is a single, unitary, uninterrupted piece, wherein the hard trauma plate (120) is effective to prevent a projectile from entering into the person at a spinal region of the person wearing the ballistic vest (100), and thereby preventing the projectile from damaging the person's spine;

wherein the single pocket (110) is adapted to accommodate the single, unitary hard trauma plate (120), wherein the ballistic vest (100) consists of only one pocket (110) adapted to accommodate the single, unitary hard trauma plate (120), wherein the location of the attachment for the flap is designed for preventing the single, unitary hard trauma plate (120) from sliding upwards out of the single pocket (110), wherein the flap (112) temporarily closes the opening of the single pocket (110) to secure the single, unitary hard trauma plate (120) therein, wherein a first side top vest attachment member (210) is disposed on a plane, Plane A, at a pocket midpoint (430) of the single pocket (110) on a vest first side (200) between the pocket top (410) and the pocket bottom (420), wherein a second side top vest attachment member (310) is disposed on the plane, Plane A, at a pocket midpoint (430) of the single pocket (110) on a vest second side (300) between the pocket top (410) and the pocket bottom (420), wherein a first side bottom vest attachment member (220) is disposed on a plane, Plane B, between the first side top vest attachment member (210) and the lowest tip of the single pocket (110) on a vest first side (200), wherein a second side bottom vest attachment member (320) is disposed on a plane, Plane B, between the second side top vest attachment member (310) and the lowest tip of the single pocket (110) on a vest second side (300).

* * * * *